US007328527B2

(12) United States Patent
Goldman

(10) Patent No.: US 7,328,527 B2
(45) Date of Patent: Feb. 12, 2008

(54) SHOE STRAP CHANGING SYSTEM

(75) Inventor: Jared Goldman, Canton, MA (US)

(73) Assignee: Reebok International Ltd., Canton, MA (US)

( * ) Notice: Subject to any disclaimer, the term of this patent is extended or adjusted under 35 U.S.C. 154(b) by 303 days.

(21) Appl. No.: 10/927,417

(22) Filed: Aug. 27, 2004

(65) Prior Publication Data

US 2005/0115109 A1 Jun. 2, 2005

Related U.S. Application Data

(60) Provisional application No. 60/497,926, filed on Aug. 27, 2003.

(51) Int. Cl.
*A43B 7/14* (2006.01)

(52) U.S. Cl. ..... 36/100; 36/88

(58) Field of Classification Search ..... 36/88, 36/91, 100, 101, 136, 72 R
See application file for complete search history.

(56) References Cited

U.S. PATENT DOCUMENTS 2,126,094 A 8/1938 Daniels
2,236,367 A * 3/1941 Gruber ..... 36/101
2,239,206 A 4/1941 Tietig
2,381,389 A 8/1945 Riesing
2,421,818 A 6/1947 Tibiletti
2,454,181 A 11/1948 Jordan
2,491,297 A * 12/1949 Brown ..... 36/94
2,495,984 A * 1/1950 Roy ..... 36/15
2,496,782 A 2/1950 Engel
3,119,191 A * 1/1964 Vitzthum ..... 36/84
3,251,144 A 5/1966 Weitzner
3,305,947 A 2/1967 Kalsoy
3,698,108 A 10/1972 Brunner
3,983,642 A 10/1976 Liao
3,994,080 A * 11/1976 Flanagan et al. ..... 36/100
4,300,294 A * 11/1981 Riecken ..... 36/97

(Continued)

FOREIGN PATENT DOCUMENTS

DE 2 009 980 10/1970

(Continued)

*Primary Examiner*—Marie Patterson
(74) *Attorney, Agent, or Firm*—Sterne, Kessler, Goldstein & Fox P.L.L.C.

(57) ABSTRACT

The shoe strap changing system of the present invention consists of a base shoe, which includes an upper and a sole. The sole includes a slot, which has a height, a width extending from near the heel portion of the sole across the middle portion of the sole toward the toe portion of the sole, and a depth extending from the medial side of the sole to the lateral side of the sole. The position and size of the slot enables various size straps to encircle the upper of the base shoe, thereby providing stability for the user's foot and versatility of the appearance of the base shoe. Since the slot accommodates various size straps, the base shoe may form the basis for a shoe strap changing system. A user can remove a first strap from the base shoe, and place a second strap through the slot. The second strap may have the same or different characteristics of the first strap. Therefore, the shoe strap changing system allows a user to change the appearance and stability of the base shoe by altering characteristics such as size, shape, and color of the strap that encompasses at least a portion of the upper.

47 Claims, 13 Drawing Sheets

U.S. PATENT DOCUMENTS 4,314,412 A * 2/1982 Anderson et al. ..... 36/100
4,458,431 A 7/1984 Sinclair
4,461,102 A 7/1984 DeVincentis
4,476,639 A * 10/1984 Zaccaria ..... 36/114
4,535,554 A 8/1985 De Obaldia B.
5,148,614 A 9/1992 Kelly
5,181,331 A 1/1993 Berger
5,291,671 A 3/1994 Caberlotto et al.
5,392,535 A 2/1995 Van Noy et al.
5,416,987 A 5/1995 Bemis et al.
5,459,949 A 10/1995 MacPhail
5,526,585 A 6/1996 Brown et al.
5,659,978 A 8/1997 Bell et al.
5,689,901 A 11/1997 Bell et al.
5,692,319 A 12/1997 Parker et al.
5,819,439 A * 10/1998 Sanchez ..... 36/89
5,992,058 A 11/1999 Jneid
6,076,284 A 6/2000 Terlizzi
6,088,936 A 7/2000 Bahl
6,094,844 A 8/2000 Potts
6,105,280 A 8/2000 Marcolin
6,108,943 A 8/2000 Hudson et al.
6,115,946 A 9/2000 Morris et al.
6,128,834 A 10/2000 Vecchiola et al.
6,128,835 A 10/2000 Ritter et al.
6,131,312 A 10/2000 Hung
6,138,384 A 10/2000 Messmer
6,151,804 A 11/2000 Hieblinger
6,151,806 A 11/2000 Morris et al.
6,158,150 A 12/2000 Morris et al.
6,212,797 B1 * 4/2001 Merry et al. ..... 36/101
6,393,733 B1 5/2002 London et al.
6,499,234 B2 * 12/2002 Manzi ..... 36/100
6,543,157 B2 * 4/2003 Pan ..... 36/11.5
6,772,541 B1 * 8/2004 Ritter et al. ..... 36/88
6,792,696 B2 * 9/2004 Berg et al. ..... 36/11.5
7,028,420 B2 * 4/2006 Tonkel ..... 36/100
2002/0078600 A1 * 6/2002 Berg et al. ..... 36/101
2002/0100189 A1 * 8/2002 Manzi ..... 36/100
2002/0124433 A1 * 9/2002 Pan ..... 36/11.5
2004/0118016 A1 * 6/2004 Tonkel ..... 36/11.5
2005/0039344 A1 * 2/2005 Berg et al. ..... 36/11.5

FOREIGN PATENT DOCUMENTS

FR 2 489 103 3/1982
FR 2 649 593 1/1991
GB 2 071 481 A 9/1981

* cited by examiner

SHOE STRAP CHANGING SYSTEM

BACKGROUND OF THE INVENTION

1. Field of the Invention

The field of this invention generally relates to footwear, and more particularly to a shoe strap changing system for an article of footwear.

2. Background Art

One of the primary goals of footwear is to provide stability for a foot while still maintaining comfort for the user. However, a user's desired level of stability may vary with the circumstances surrounding the user. For example, a user may desire a higher level of stability when exercising or playing a sport, but may desire a lower level of stability when sightseeing or running errands.

It is therefore an objective of the present invention to provide stability and comfort for a foot by providing a base shoe with a strap that encircles the outside of the base shoe and encompasses at least a portion of the upper of the base shoe.

A further objective of the present invention to provide a shoe strap changing system that allows a user to alter the stability of the base shoe as desired by altering characteristics such as the size and shape of the strap that encompasses at least a portion of the upper.

It is another objective of the present invention to provide a shoe strap changing system that allows a user to alter the appearance of the base shoe as desired by altering characteristics such as the size, shape, and color of the strap that encompasses at least a portion of the upper.

BRIEF SUMMARY OF THE INVENTION

To achieve the foregoing and other objects, and in accordance with the purposes of the present invention as embodied and broadly described herein, the shoe strap changing system of the present invention consists of a base shoe, including an upper and a sole. The sole of the base shoe has a toe portion, a middle portion, a heel portion, a medial side and a lateral side. In addition, the sole includes a slot. The slot has a height, a width extending from near the heel portion of the sole across the middle portion of the sole, and a depth extending from the medial side of the sole to the lateral side of the sole.

The position and size of the slot enables various size straps to encircle the outside of the base shoe, thereby providing stability for the user's foot and versatility of the appearance of the base shoe. As illustrated in the figures, the slot may accommodate straps such as a single strap, a double strap, a half shroud, or a full shroud.

Since the slot accommodates various size straps, the base shoe may form the basis for a shoe strap changing system. The base shoe may contain a first strap, which may be for example a single strap, a double strap, a half shroud, or a full shroud. The first strap extends through the slot and encompasses at least a portion of the upper of the base shoe. The first strap is removable and replaceable by a second strap. The second strap may be the same or a different shape and size from the first strap. Another application of the present invention is that a user may remove the first strap from the base shoe, and place a second strap of a different color from the first strap.

The shoe strap changing system of the present invention thereby allows a user to alter the stability of the base shoe as desired by altering characteristics such as size and shape of the strap that encompasses at least a portion of the upper.

In addition, the user may alter the appearance of the base shoe as desired by altering characteristics such as size, shape, and color of the strap that encompasses at least a portion of the upper.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE INVENTION

A preferred embodiment of the present invention is now described with reference to the figures, where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention.

Figure 1:
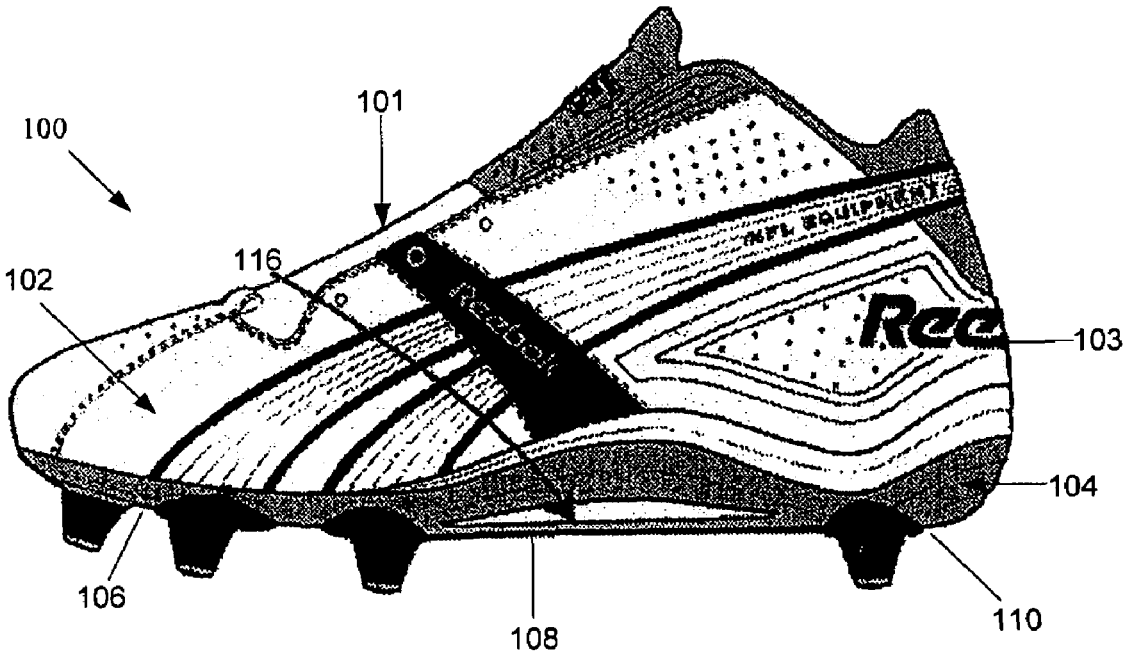
FIG. 1 is a side view of a base shoe according to the present invention.

As shown in FIG. 1, the shoe strap changing system of the present invention consists of a base shoe 100, which includes an upper 102 and a sole 104. FIG. 1 is a side view of a base shoe 100. Upper 102 has a vamp portion 101 and a back portion 103. Sole 104 has a toe portion 106, a middle portion 108, and a heel portion 110. A person skilled in the relevant art will recognize that sole 104 of the present invention may be a mid-sole or an outer-sole without departing from the spirit and scope of the invention. As shown on FIG. 7, sole 104 has a medial side 712 and a lateral side 714.

Figure 2:
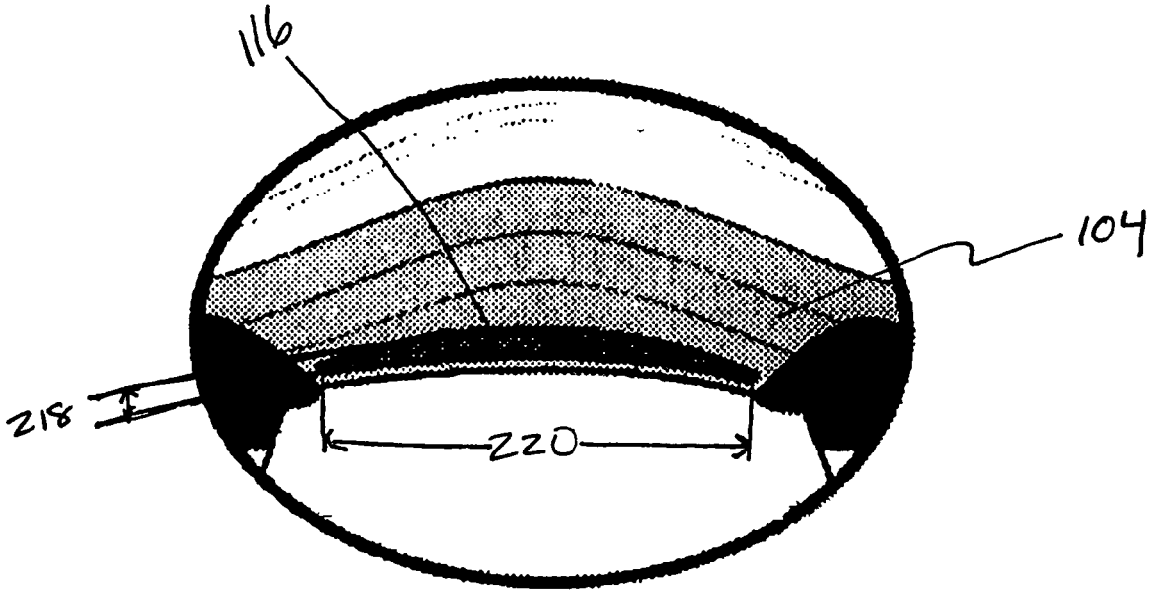
FIG. 2 is an enlarged view of slot 116 of the shoe of FIG. 1.
Figure 7:
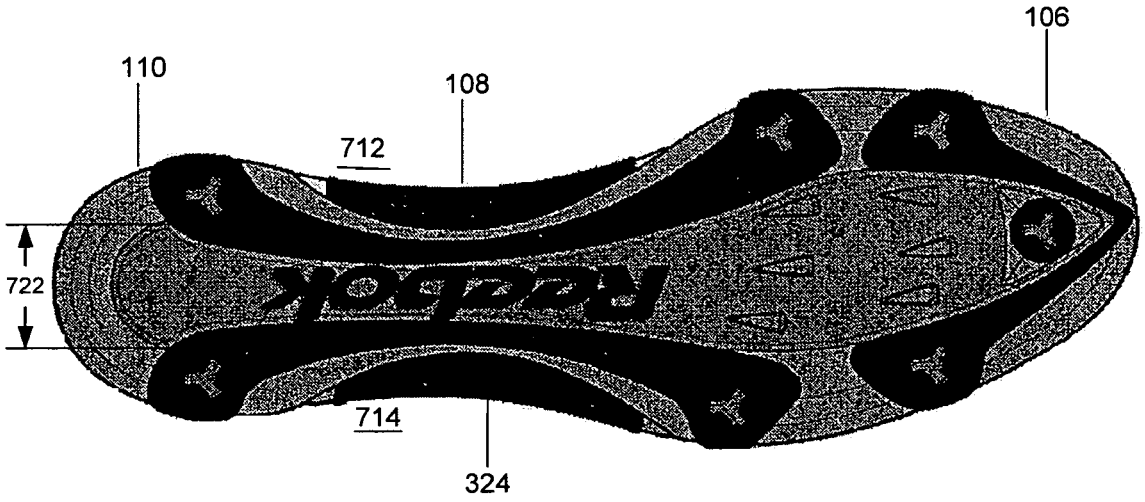
FIG. 7 is a bottom view of the shoe of FIG. 3.

Referring to FIGS. 1, 2, and 7, sole 104 includes a slot 116. FIG. 2 shows an enlarged view of slot 116. Slot 116 has a height 218, a width 220 extending from near heel portion 110 of sole 104 across middle portion 108 of sole 104, and a depth 722 extending from medial side 712 of sole 104 to lateral side 714 of sole 104. As explained in detail below, the position and size of slot 116 enables various size straps to encircle the outside of base shoe 100, thereby providing stability for the user's foot and versatility of the appearance of the base shoe.

Figure 3:
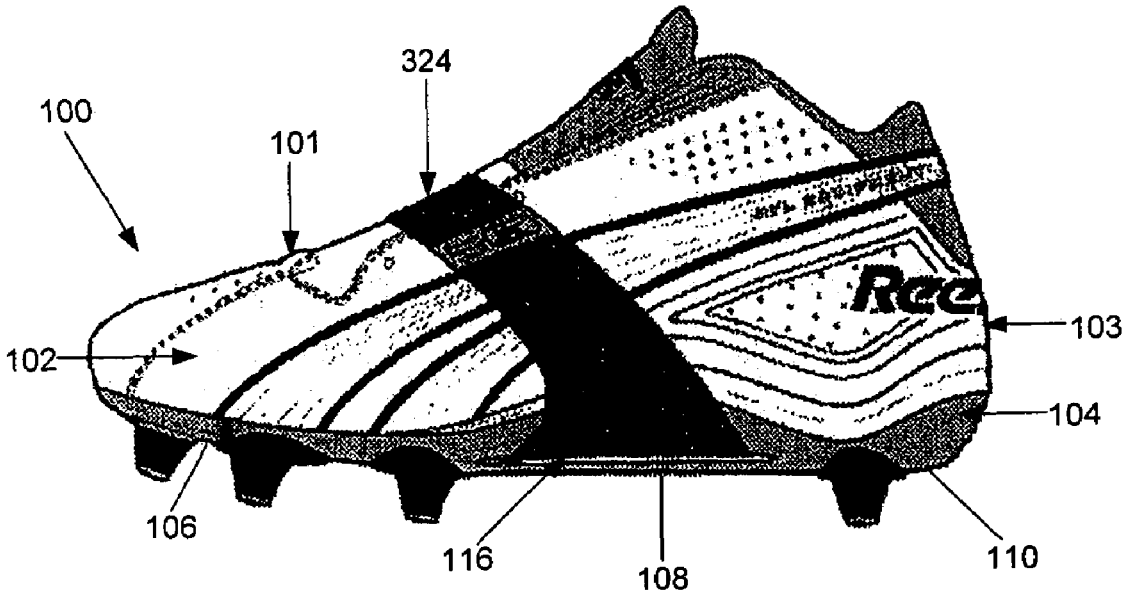
FIG. 3 is a side view of the shoe of FIG. 1 with a single strap.
Figure 8:
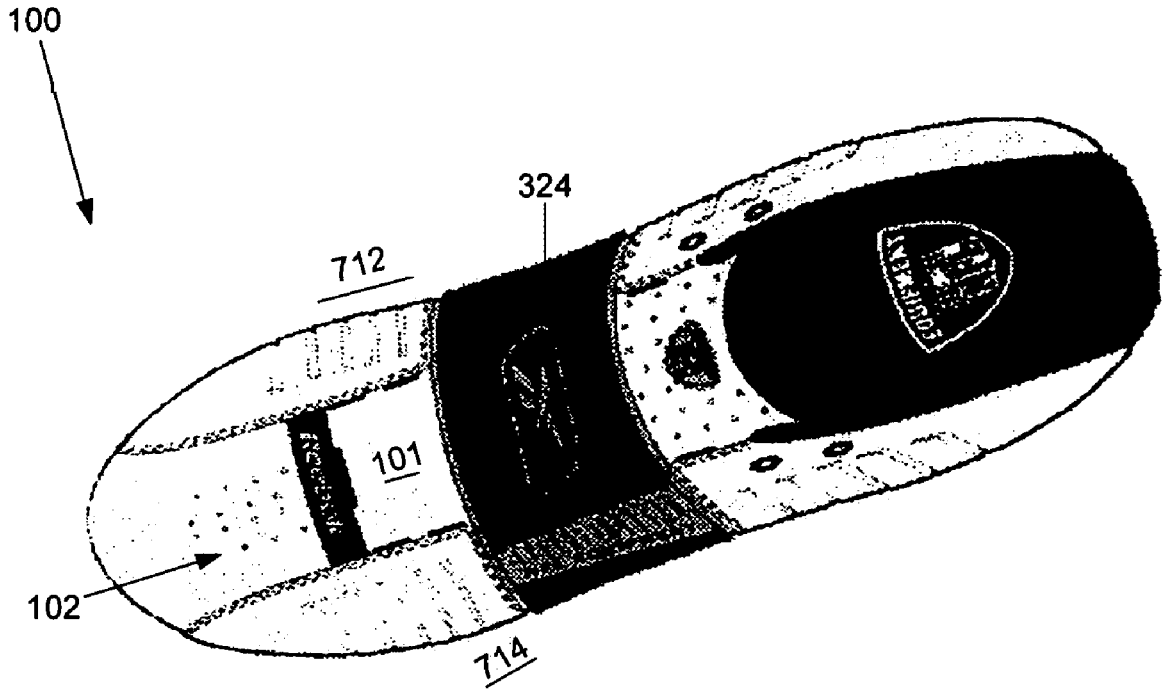
FIG. 8 is a top view of the shoe of FIG. 3.
Figure 9:
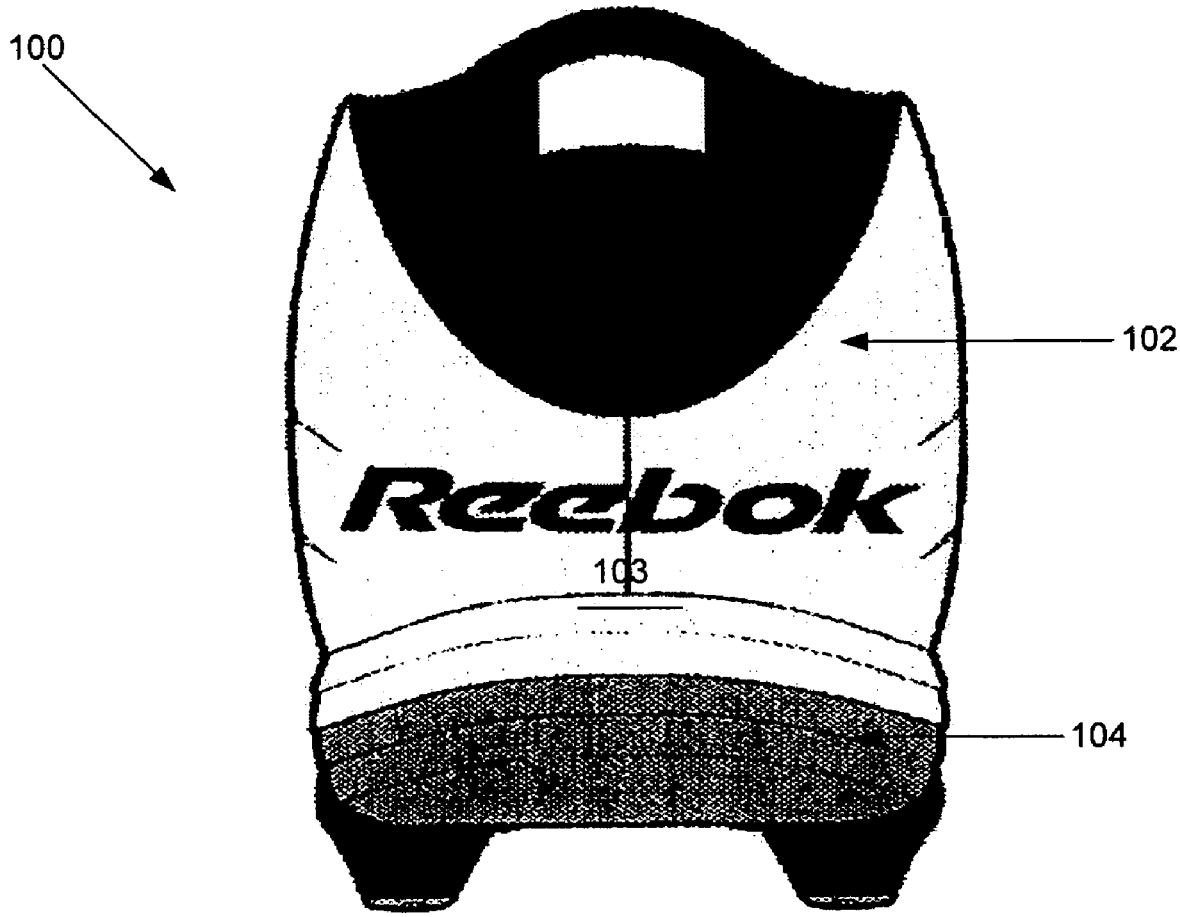
FIG. 9 is a back view of the shoe of FIG. 3.
Figure 10:
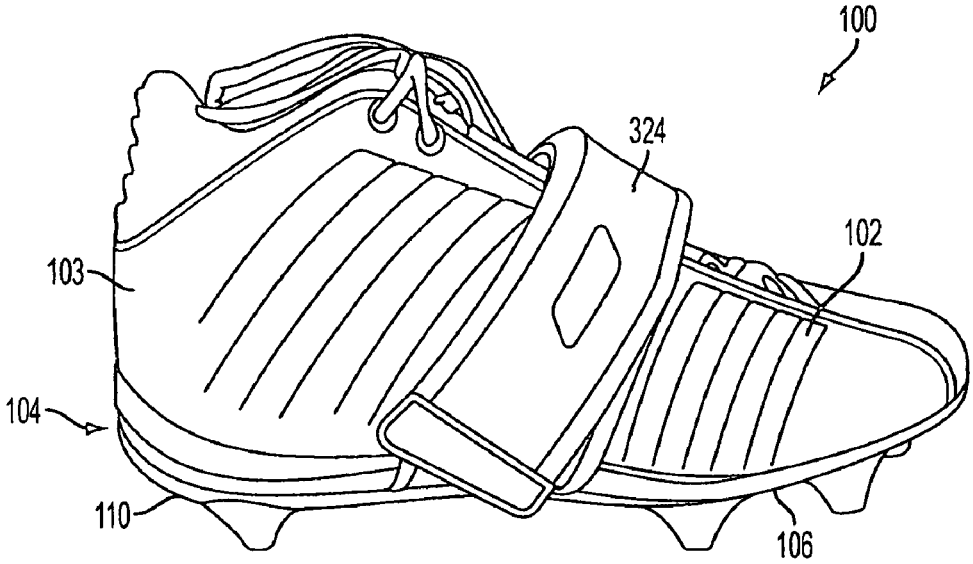
FIG. 10 is a side view of an alternate embodiment of the base shoe of the present invention with a single strap.
Figure 11:
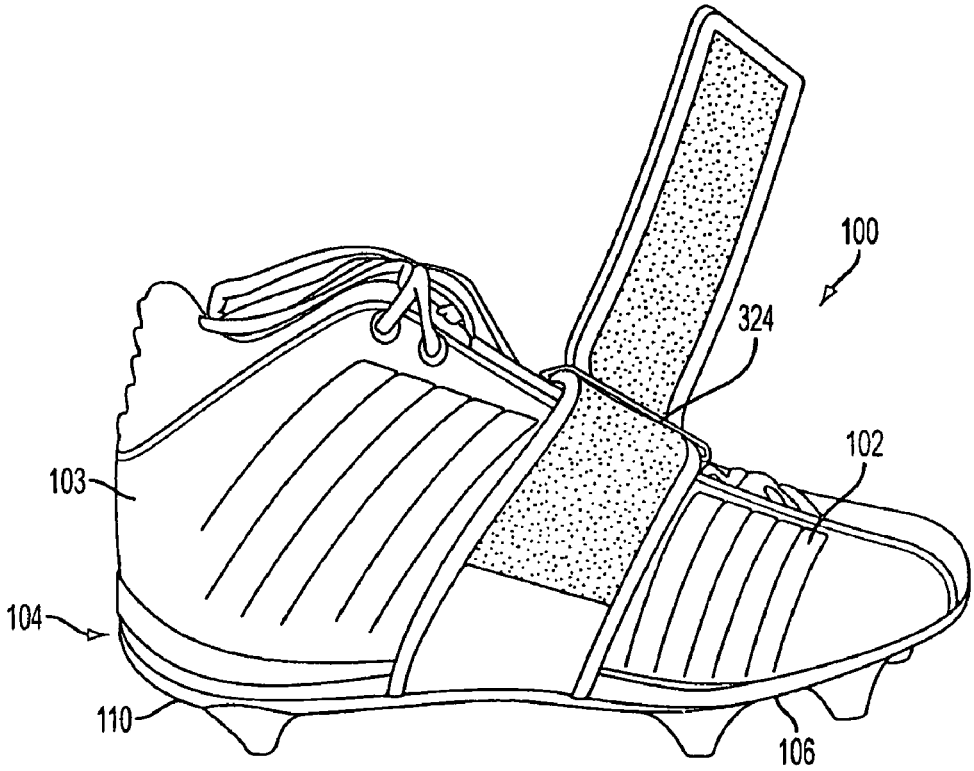
FIG. 11 is a side view of the shoe of FIG. 10 with the single strap unfastened.

As illustrated in FIGS. 3-6, slot 116 accommodates various size straps. The strap chosen by the user effects both the stability and appearance of base shoe 100. FIG. 3 illustrates base shoe 100 with a single strap 324, such that single strap 324 extends though slot 116 and around vamp portion 101 of upper 102. A user may secure single strap 324 with any appropriate fastening device, such as hook and loop pile fastening material known by the trademark VELCRO. In addition, FIG. 7 illustrates a bottom view of FIG. 3, FIG. 8 is a top view of FIG. 3, and FIG. 9 is a back view of FIG. 3.

Figure 4:
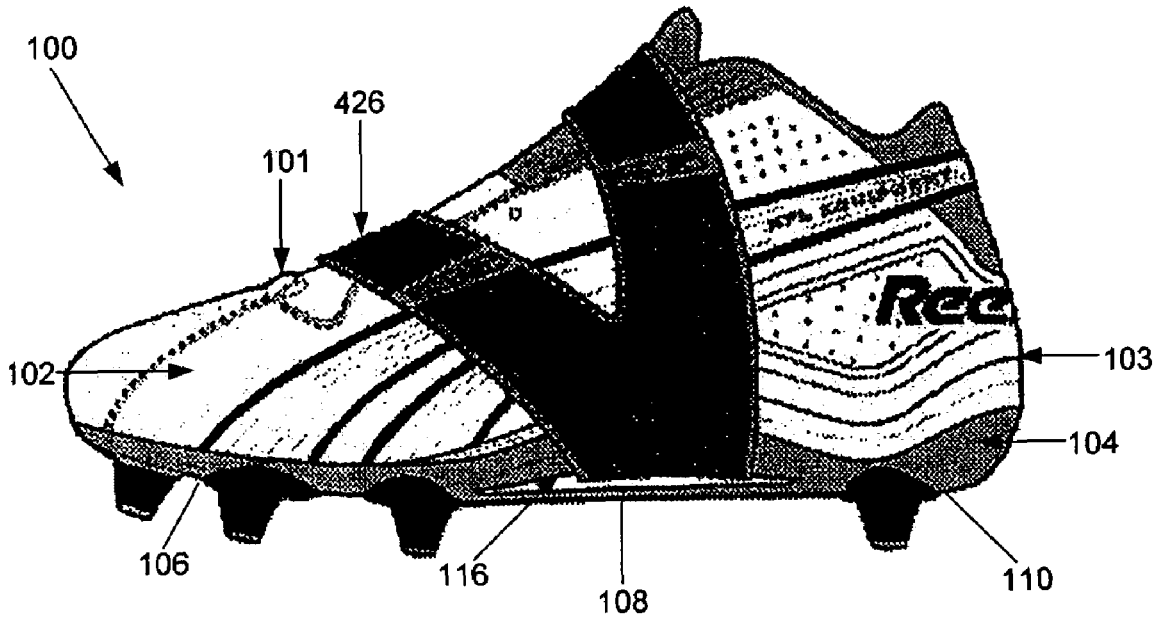
FIG. 4 is a side view of the shoe of FIG. 1 with a double strap.

FIG. 4 illustrates base shoe 100 with a double strap 426, such that double strap 426 extends through slot 116 and around vamp portion 101 of upper 102. Double strap 426 provides the user with more stability and a different appearance than single strap 324, since double strap 426 will cover more surface area of upper 102 than single strap 324. Again, a user may secure double strap 426 with any appropriate fastening device, such as hook and loop pile fastening material known by the trademark VELCRO.

Figure 5:
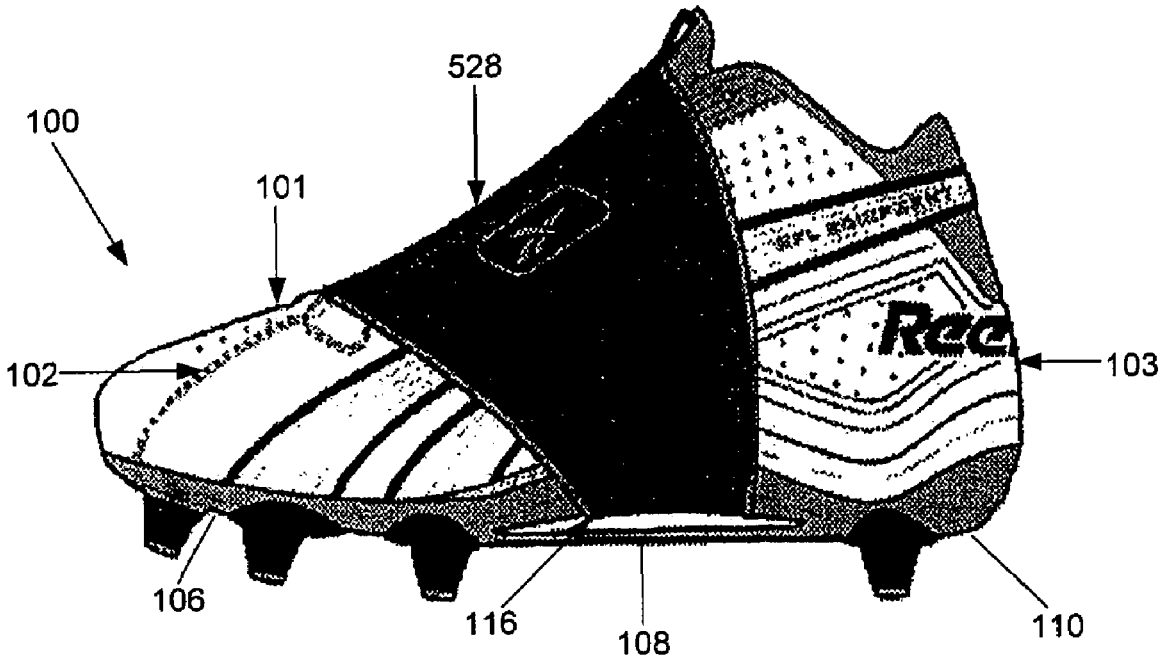
FIG. 5 is a side view of the shoe of FIG. 1 with a half shroud.

FIG. 5 shows base shoe 100 with a half shroud 528, such that half shroud 528 extends through slot 116 and around vamp portion 101 of upper 102. Half shroud 528 provides the user with more stability and a different appearance than both single strap 324 and double strap 426, since half shroud 528 will cover more surface area of upper 102 than both single strap 324 and double strap 426. Again, a user may secure half shroud 528 with any appropriate fastening device, such as hook and loop pile fastening material known by the trademark VELCRO.

Figure 6:
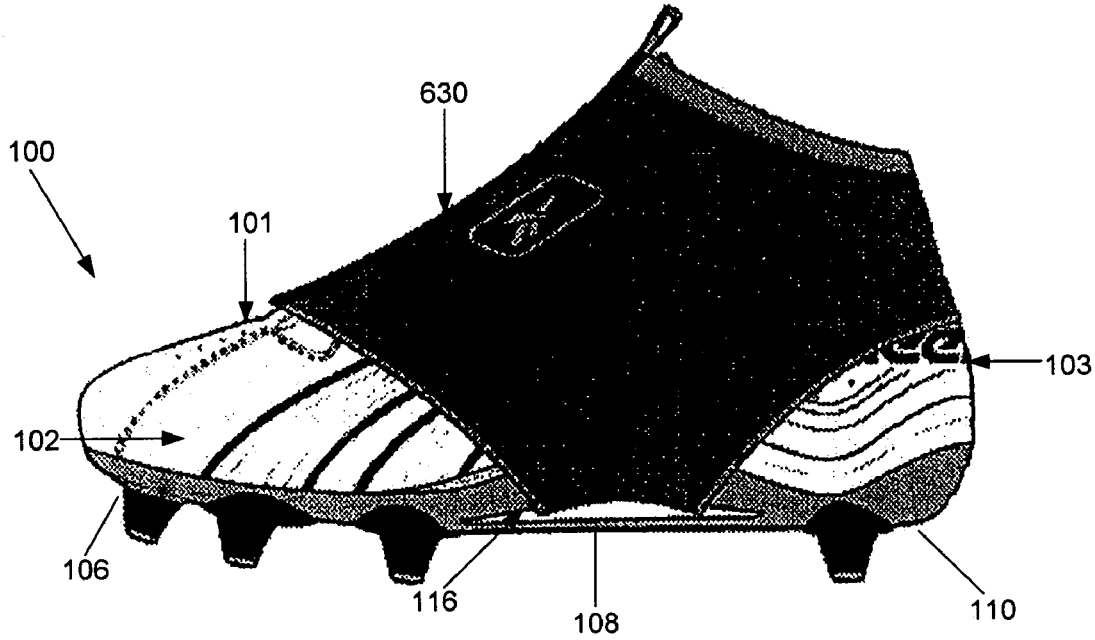
FIG. 6 is a side view of the shoe of FIG. 1 with a full shroud.

FIG. 6 shows base 100 with a full shroud 630, where full shroud 630 extends through slot 116 and around vamp portion 101 and back portion 103 of upper 102. Full shroud 630 provides the user with more stability and a different appearance than either single strap 324, double strap 426, or half shroud 528 since full shroud 630 will cover more surface area of upper 102 than either single strap 324, double strap 426, or half shroud 528. Again, a user may secure full shroud 630 with any appropriate fastening device, such as hook and loop pile fastening material known by the trademark VELCRO.

Since slot 116 accommodates various size straps, base shoe 100 may form the basis for a shoe strap changing system. For example, base shoe 100 may contain a first strap (i.e., single strap 324, double strap 426, half shroud 528, or full shroud 630) which extends through slot 116 and encompasses at least a portion of upper 102. The first strap is removable and replaceable by a second strap, which may be of the same or different shape and size of the first strap. Therefore, a user can remove the first strap from base shoe 100, and place the second strap (i.e., single strap 324, double strap 426, half shroud 528, or full shroud 630) through slot 116. The shoe strap changing system of the present invention therefore allows a user to change the first strap around base shoe 100. By changing the size and shape of the first strap around base shoe 100, a user can alter the stability of base shoe 100 as desired. Or as an alternate application of the present invention, a user can replace the first strap with a second strap that is the same size and shape as the first strap if the first strap becomes worn out, damaged or broken.

Figure 14:
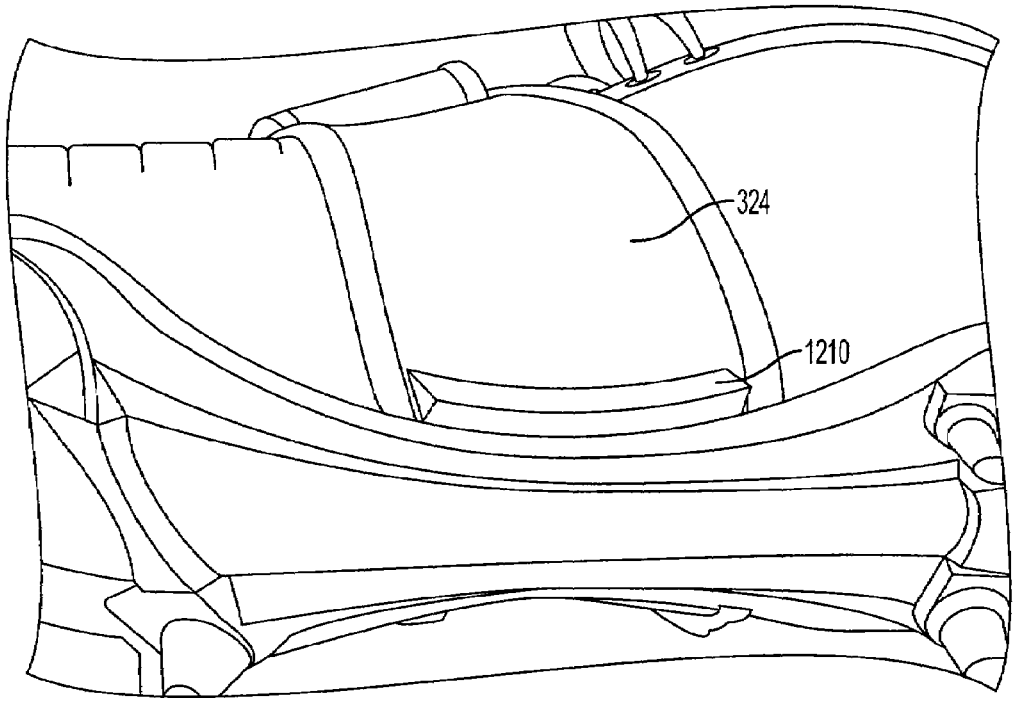
FIG. 14 is an enlarged view of slot 116 of the shoe of FIG. 10 with the single strap extending through slot 116.
Figure 15:
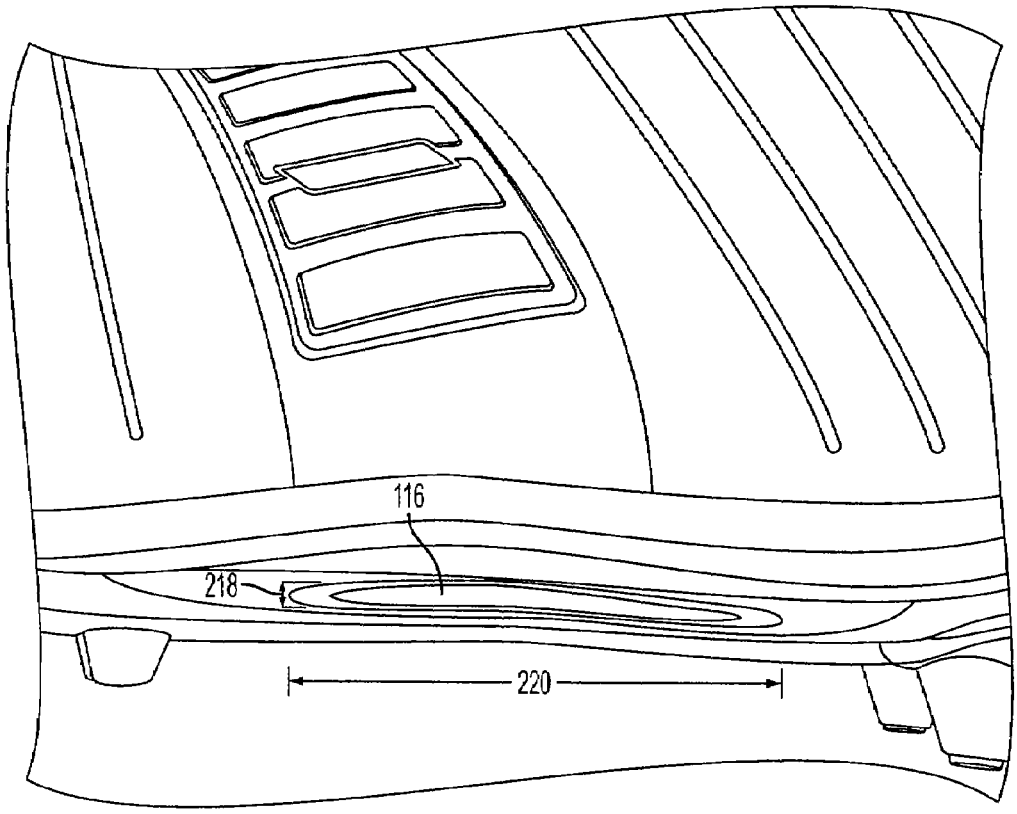
FIG. 15 is an enlarged view of slot 116 of the shoe of FIG. 10 with the single strap removed.
Figure 16:
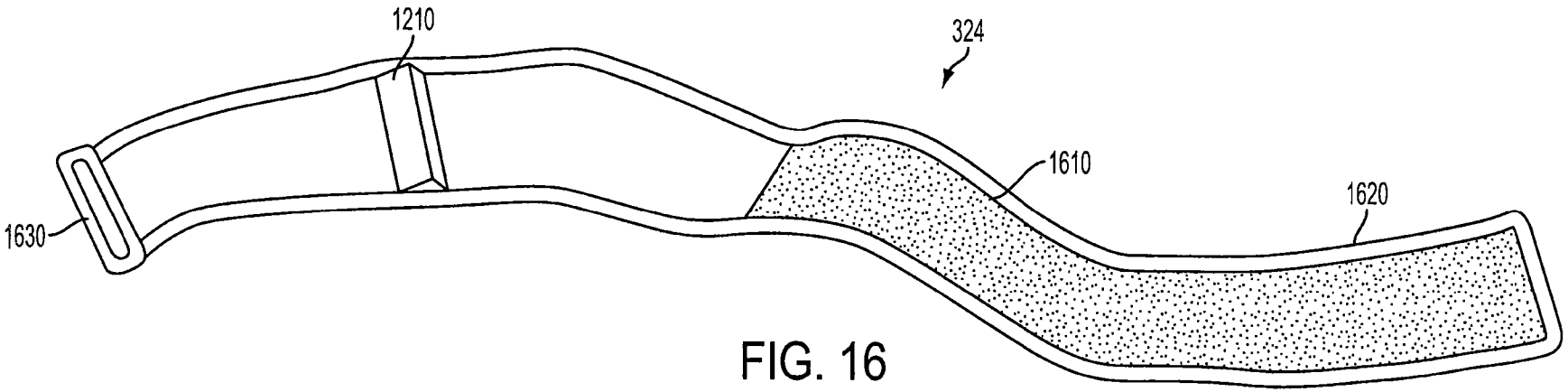
FIG. 16 is a top view of the single strap of the shoe of FIG. 10.
Figure 17:
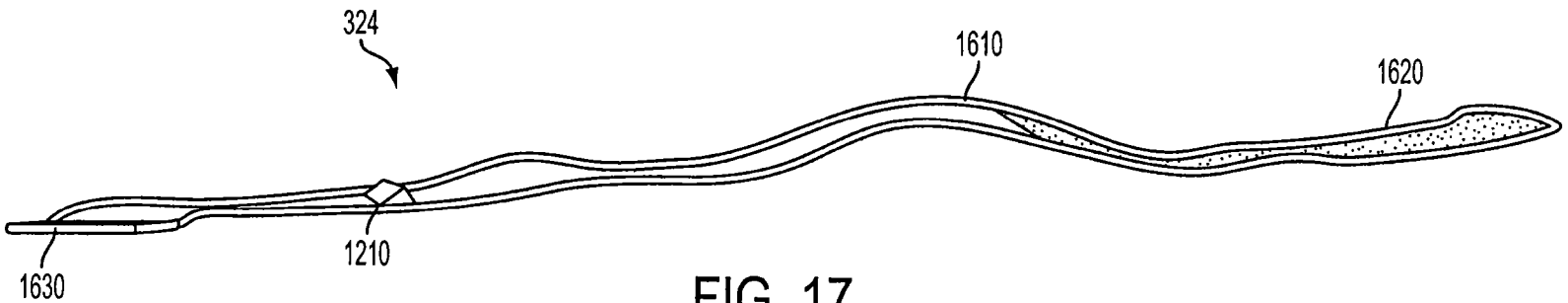
FIG. 17 is a side view of the single strap of the shoe of FIG. 10.

FIGS. 10-17 show an alternate embodiment of the base shoe 100 of the present invention with a single strap 324. Like reference numerals have been used to designate common elements between the base shoe of FIG. 10 and the base shoe of FIG. 1. As shown in FIGS. 16 and 17, single strap 324 includes a hook 1610 and loop pile 1620 fastening device and a buckle 1630. As shown in FIGS. 10-14, single strap 324 extends though slot 116 and around vamp portion 101 of upper 102. Single strap 324 is secured by feeding single strap 324 through buckle 1630 and affixing loop pile 1620 to hook 1610. Alternative fastening devices could also be used, as would be apparent to one of ordinary skill in the art. FIG. 15 shows a detailed view of slot 116 of the shoe of FIG. 10 with the single strap removed. As with the embodiment of FIG. 1, slot 116 of the shoe of FIG. 10 can accommodate various size straps, chosen by the user to effect both the stability and appearance of base shoe 100.

Another application of the present invention is that a user may remove the first strap from base shoe 100, and place a second strap of a different color from the first strap. The second strap may be of the same or different shape and size of the first strap. For example, a sports team may want to coordinate the color of the second strap to match the color of their uniforms. Or, an individual user may want to coordinate the color of the second strap to match the color associated with a particular holiday, such as green for St. Patrick's Day or red for Valentine's Day. Therefore, the user may alter the appearance of base shoe 100 as desired by altering the size, shape, and color of the strap that encompasses at least a portion of upper 102.

Figure 12:
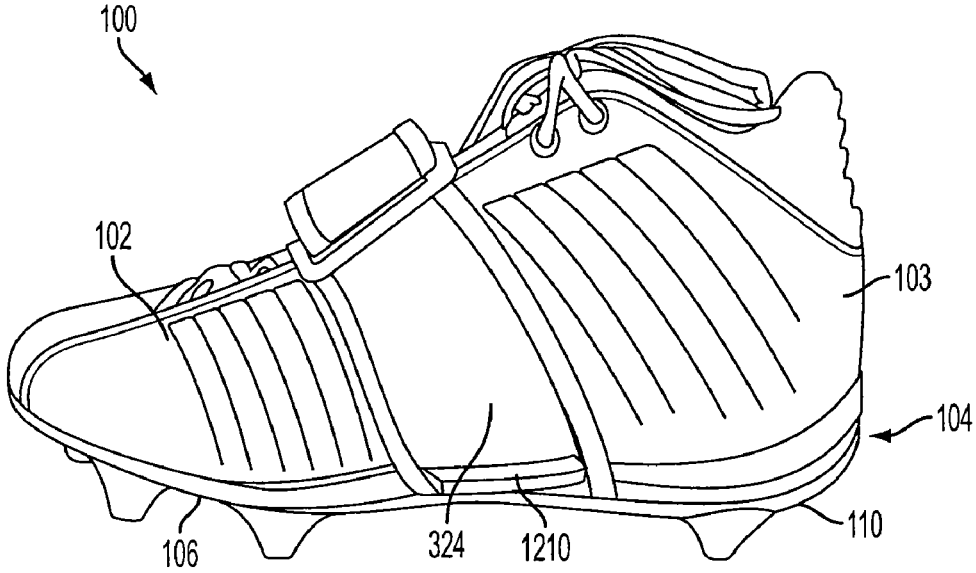
FIG. 12 is an opposite side view of the shoe of FIG. 10.
Figure 13:
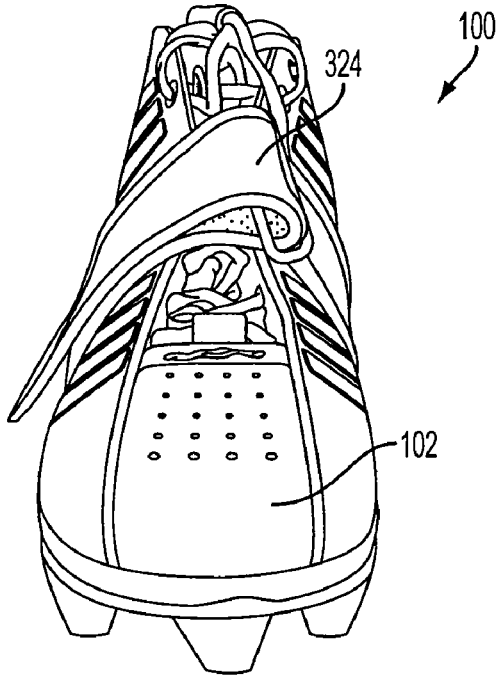
FIG. 13 is a front view of the shoe of FIG. 10.

In addition, the first strap and/or the second strap utilized in the shoe strap changing system of the present invention may further comprise a rubber stopper 1210, as shown in FIG. 12, attached to the first strap and/or the second strap. As shown in FIG. 14, rubber stopper 1210 has a height greater than height 218 of slot 116, and therefore aids in securing the first strap and/or the second strap to base shoe 100. As the user pulls and secures the first strap and/or the second strap around upper 102, rubber stopper 1210 will be pulled against slot 116 and therefore help secure the first strap and/or the second strap around base shoe 100. Rubber stopper 1210 may be of any appropriate size and shape, and made of any appropriate material such that the rubber stopper is deformable enough to allow the first strap and/or the second strap to be removed from base shoe 100, as shown in FIGS. 16 and 17.

While this invention has been particularly shown and described with reference to preferred embodiments thereof, it will be understood by those skilled in the art that various changes in form and details may be made therein without departing from the spirit and scope of the invention.

What is claimed is:

1. An article of footwear, comprising:

an upper;

a sole having a toe portion, a middle portion, a heel portion, a medial side and a lateral side, wherein said sole includes a slot having a height, a width extending from near the heel portion of said sole across the middle portion of said sole toward the toe portion of said sole, and a depth extending from the medial side of said sole to the lateral side of said sole; and a first strap having a stopper attached to said first strap, wherein the stopper is disposed in a location away from the ends of said first strap, wherein the stopper has a height greater than the height of said slot so as to provide leverage for tightening said strap and to limit movement of said first strap through said slot, wherein said first strap extends through said slot and around at least a portion of said upper and said first strap is removable and replaceable by a second strap.

2. The article of footwear of claim 1, wherein said second strap has a different size as compared to said first strap.

3. The article of footwear of claim 1, wherein said second strap has a different shape as compared to said first strap.

4. The article of footwear of claim 1, wherein said second strap is a different color than said first strap.

5. The article of footwear of claim 1, further comprising a rubber stopper attached to said second strap, wherein the rubber stopper has a height greater than the height of said slot.

6. The article of footwear of claim 1, wherein said first strap is a single strap.

7. The article of footwear of claim 1, wherein said first strap is a double strap.

8. The article of footwear of claim 1, wherein said first strap is a half shroud.

9. The article of footwear of claim 1, wherein said first strap is a full shroud.

10. The article of footwear of claim 1, wherein said second strap is a single strap.

11. The article of footwear of claim 1, wherein said second strap is a double strap.

12. The article of footwear of claim 1, wherein said second strap is a half shroud.

13. The article of footwear of claim 1, wherein said second strap is a full shroud.

14. A shoe strap changing system, comprising:

a shoe having an upper and a sole, said sole having a toe portion, a middle portion, a heel portion, a medial side and a lateral side, a slot formed within said sole, said slot having a height, a width extending from near the heel portion of said sole across the middle portion of said sole toward the toe portion of said sole, and a depth extending from the medial side of said sole to the lateral side of said sole;

a first strap having a stopper attached to said first strap, wherein the stopper is disposed in a location away from the ends of said first strap, wherein the stopper has a height greater than the height of said slot so as to provide leverage for tightening said strap and to limit movement of said first strap through said slot, wherein said first strap extends through said slot and around at least a portion of said upper; and a second strap, wherein said first strap is removable and replaceable by said a second strap and said second strap has a different shape from said first strap.

15. The article of footwear of claim 14, wherein said second strap is a different color from said first strap.

16. The shoe strap changing system of claim 14, further comprising a rubber stopper attached to said second strap, wherein the rubber stopper has a height greater than the height of said slot.

17. The shoe strap changing system of claim 14, wherein said first strap is a single strap.

18. The shoe strap changing system of claim 14, wherein said first strap is a double strap.

19. The shoe strap changing system of claim 14, wherein said first strap is a half shroud.

20. The shoe strap changing system of claim 14, wherein said first strap is a full shroud.

21. The shoe strap changing system of claim 14, wherein said second strap is a single strap.

22. The shoe strap changing system of claim 14, wherein said second strap is a double strap.

23. The shoe strap changing system of claim 14, wherein said second strap is a half shroud.

24. The shoe strap changing system of claim 14, wherein said second strap is a full shroud.

25. A shoe strap changing system, comprising:

a shoe having an upper and a sole, said sole having a toe portion, a middle portion, a heel portion, a medial side and a lateral side, a slot formed within said sole, said slot having a height, a width extending from near the heel portion of said sole across the middle portion of said sole toward the toe portion of said sole, and a depth extending from the medial side of said sole to the lateral side of said sole;

a first strap having a stopper attached to said first strap, wherein the stopper is disposed in a location away from the ends of said first strap, wherein the stopper has a height greater than the height of said slot so as to provide leverage for tightening said strap and to limit movement of said first strap through said slot, wherein said first strap extends through said slot and around at least a portion of said upper; and a second strap, wherein said first strap is removable and replaceable by said a second strap and said second strap is a different color from said first strap.

26. The shoe strap changing system of claim 25, further comprising a rubber stopper attached to said second strap, wherein the rubber stopper has a height greater than the height of said slot.

27. The shoe strap changing system of claim 25, wherein said first strap is a single strap.

28. The shoe strap changing system of claim 25, wherein said first strap is a double strap.

29. The shoe strap changing system of claim 25, wherein said first strap is a half shroud.

30. The shoe strap changing system of claim 25, wherein said first strap is a full shroud.

31. The shoe strap changing system of claim 25, wherein said second strap is a single strap.

32. The shoe strap changing system of claim 25, wherein said second strap is a double strap.

33. The shoe strap changing system of claim 25, wherein said second strap is a half shroud.

34. The shoe strap changing system of claim 25, wherein said second strap is a full shroud.

35. A method of securing an article of footwear having an upper and a sole, comprising the steps of:

feeding a first strap, having a stopper attached to said first strap, wherein the stopper is disposed in a location away from the ends of said first strap, wherein the stopper has a height greater than the height of said slot so as to provide leverage for tightening said strap and to limit movement of said first strap through said slot, through a slot formed in said sole, said slot having a height, a width extending from near the heel portion of said sole across the middle portion of said sole toward a toe portion of said sole, and a depth extending from the medial side of said sole to the lateral side of said sole;

extending said first strap around said upper, such that said first strap encompasses at least a portion of said upper; and fastening said first strap.

36. The method of claim 35, further comprising the steps of:

unfastening said first strap and removing said first strap from said slot formed in said sole;

feeding a second strap having a different shape from said first strap through said slot;

extending said second strap around said upper, such that said second strap encompasses at least a portion of said upper; and fastening said second strap.

37. The method of claim 36, wherein said second strap is a different color from said first strap.

38. The method of claim 36, wherein said second strap has a different size than said first strap.

39. The method of claim 36, wherein a rubber stopper is attached to said second strap and said rubber stopper has a height greater than the height of said slot.

40. The method of claim 35, wherein said first strap is a single strap.

41. The method of claim 35, wherein said first strap is a double strap.

42. The method of claim 35, wherein said first strap is a half shroud.

43. The method of claim 35, wherein said first strap is a full shroud.

44. The method of claim 36, wherein said second strap is a single strap.

45. The method of claim 36, wherein said second strap is a double strap.

46. The method of claim 36, wherein said second strap is a half shroud.

47. The method of claim 36, wherein said second strap is a full shroud.

* * * * *